US011834797B2

(12) United States Patent
Nelson et al.

(10) Patent No.: US 11,834,797 B2
(45) Date of Patent: Dec. 5, 2023

(54) AUTOMATIC SMOOTHNESS CONTROL FOR ASPHALT PAVER

(71) Applicant: Caterpillar Paving Products Inc., Brooklyn Park, MN (US)

(72) Inventors: Ryan J. Nelson, Maple Grove, MN (US); Ryan T. Thiesse, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 169 days.

(21) Appl. No.: 17/469,690

(22) Filed: Sep. 8, 2021

(65) Prior Publication Data

US 2023/0071875 A1 Mar. 9, 2023

(51) Int. Cl.
*E01C 23/01* (2006.01)
*E01C 19/48* (2006.01)

(52) U.S. Cl.
CPC ..... *E01C 23/01* (2013.01); *E01C 19/4853* (2013.01)

(58) Field of Classification Search
CPC ..... E01C 23/01; E01C 19/4853
See application file for complete search history.

(56) References Cited

U.S. PATENT DOCUMENTS 5,549,412 A * 8/1996 Malone ..... E01C 19/004 404/84.2
5,568,992 A * 10/1996 Grembowicz ..... E01C 19/48 404/101
7,172,363 B2 * 2/2007 Olson ..... E01C 19/48 404/75
7,470,082 B2 12/2008 Lloyd
7,643,923 B2 * 1/2010 Buehlmann ..... E01C 19/006 701/50
7,845,878 B1 * 12/2010 Godbersen ..... E01C 23/07 404/93
7,850,395 B1 * 12/2010 Brenner ..... G01B 21/30 404/75
7,856,302 B2 * 12/2010 Rasmussen ..... E01C 19/004 701/50
8,682,622 B1 * 3/2014 Brenner ..... G01C 7/04 703/2
9,290,894 B2 3/2016 Eul
9,507,348 B2 11/2016 Payne et al.
9,903,078 B2 * 2/2018 Ali ..... E01C 23/07
9,963,836 B1 5/2018 Brenner et al.
10,060,900 B2 8/2018 Kangas
11,335,381 B1 * 5/2022 Morgan ..... G06Q 50/08
11,460,981 B1 * 10/2022 Morgan ..... G06Q 10/20
11,479,927 B2 * 10/2022 Green ..... E01C 19/42
2009/0324331 A1 * 12/2009 Glee ..... E01C 23/07 404/75
2015/0139729 A1 * 5/2015 Graham ..... E01C 19/40 404/84.1

(Continued)

*Primary Examiner* — Abigail A Risic
(74) *Attorney, Agent, or Firm* — Schwegman Lundberg & Woessner, P.A.

(57) ABSTRACT

A paving machine can include a frame; a screed coupled to the frame; a plurality of sensors to scan a surface of an asphalt mat behind the screed; and a controller coupled to the plurality of sensors, the controller configured to determine a smoothness of the asphalt mat and to make changes to one or more paving characteristics of the paving machine to improve the smoothness of the asphalt mat.

20 Claims, 3 Drawing Sheets

(56) References Cited

U.S. PATENT DOCUMENTS

| | | | | |
|---|---|---|---|---|
| 2015/0361627 | A1* | 12/2015 | Frelich | B60W 10/30 180/65.245 |
| 2016/0042235 | A1* | 2/2016 | Buschmann | G01J 5/0859 348/148 |
| 2016/0160452 | A1* | 6/2016 | Orefice | E01C 23/088 701/50 |
| 2017/0233958 | A1* | 8/2017 | Utterodt | E01C 19/4833 701/50 |
| 2017/0314918 | A1* | 11/2017 | Shah | E01C 23/07 |
| 2018/0030672 | A1* | 2/2018 | Marsolek | E01C 19/42 |
| 2018/0340302 | A1* | 11/2018 | Menzenbach | E01C 19/004 |
| 2019/0078275 | A1* | 3/2019 | Shelstad | E01C 23/01 |
| 2019/0145063 | A1* | 5/2019 | Jorgensen | E01C 19/48 404/118 |
| 2019/0332082 | A1* | 10/2019 | Wright | G05B 19/19 |
| 2020/0048843 | A1 | 2/2020 | Kelly | |
| 2021/0010210 | A1* | 1/2021 | Ellwein | E01C 19/004 |
| 2021/0301479 | A1* | 9/2021 | Weiler | G06T 7/41 |
| 2022/0112669 | A1* | 4/2022 | Weiser | E01C 19/006 |
| 2022/0290383 | A1* | 9/2022 | Buschmann | E01C 19/00 |
| 2022/0307204 | A1* | 9/2022 | Nelson | G05D 1/024 |
| 2022/0341104 | A1* | 10/2022 | Seeman | E01C 19/004 |

* cited by examiner

AUTOMATIC SMOOTHNESS CONTROL FOR ASPHALT PAVER

TECHNICAL FIELD

The present disclosure generally relates to paving equipment. More particularly, the present disclosure relates to an asphalt paving machine.

BACKGROUND

Paving machines are used to apply, spread, and compact paving material relatively evenly over a desired surface. These machines are regularly used in the construction of roads, parking lots and other areas where a smooth durable surface is required for cars, trucks, and other vehicles to travel. An asphalt paving machine generally includes a hopper for receiving asphalt material from a truck and a conveyor system for transferring the asphalt rearwardly from the hopper for discharge onto a roadbed. Screw augers may be used to spread the asphalt transversely across the roadbed in front of a screed. A screed plate on the screed smooths and somewhat compacts the asphalt material and ideally leaves a roadbed of uniform depth and smoothness.

Currently, a machine operator controls multiple variables of the machine operation and screed operation to maintain a smooth asphalt mat product behind the machine. However, the manual operation can result in human error and lack of smoothness in the finished road surface.

US 2021/0010210 describes a paving machine with sensors on the screed to help generate a boundary map of the screed width.

SUMMARY

In an example according to this disclosure, a paving machine can include a frame; a screed coupled to the frame; a plurality of sensors to scan a surface of an asphalt mat behind the screed; and a controller coupled to the plurality of sensors, the controller configured to determine a smoothness of the asphalt mat and to make changes to one or more paving characteristics of the paving machine to improve the smoothness of the asphalt mat.

In one example, an automatic smoothness system for a paving machine can include a plurality of sensors positioned to scan a surface of an asphalt mat behind a screed of the paving machine; and a controller coupled to the plurality of sensors, the controller configured to determine a smoothness of the asphalt mat and to make changes to one or more paving characteristics of the paving machine to improve the smoothness of the asphalt mat, wherein the controller is configured to form a virtual 3D map of the surface of the asphalt mat based on input from the plurality of sensors, wherein the virtual 3D map covers an entire width of the screed.

In one example, a method of controlling a smoothness of an asphalt mat behind a paving machine can include positioning a plurality of sensors to scan a surface of an asphalt mat behind a screed of the paving machine; determining a smoothness of the asphalt mat using a controller coupled to the plurality of sensors; and changing one or more paving characteristics of the paving machine to improve the smoothness of the asphalt mat.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
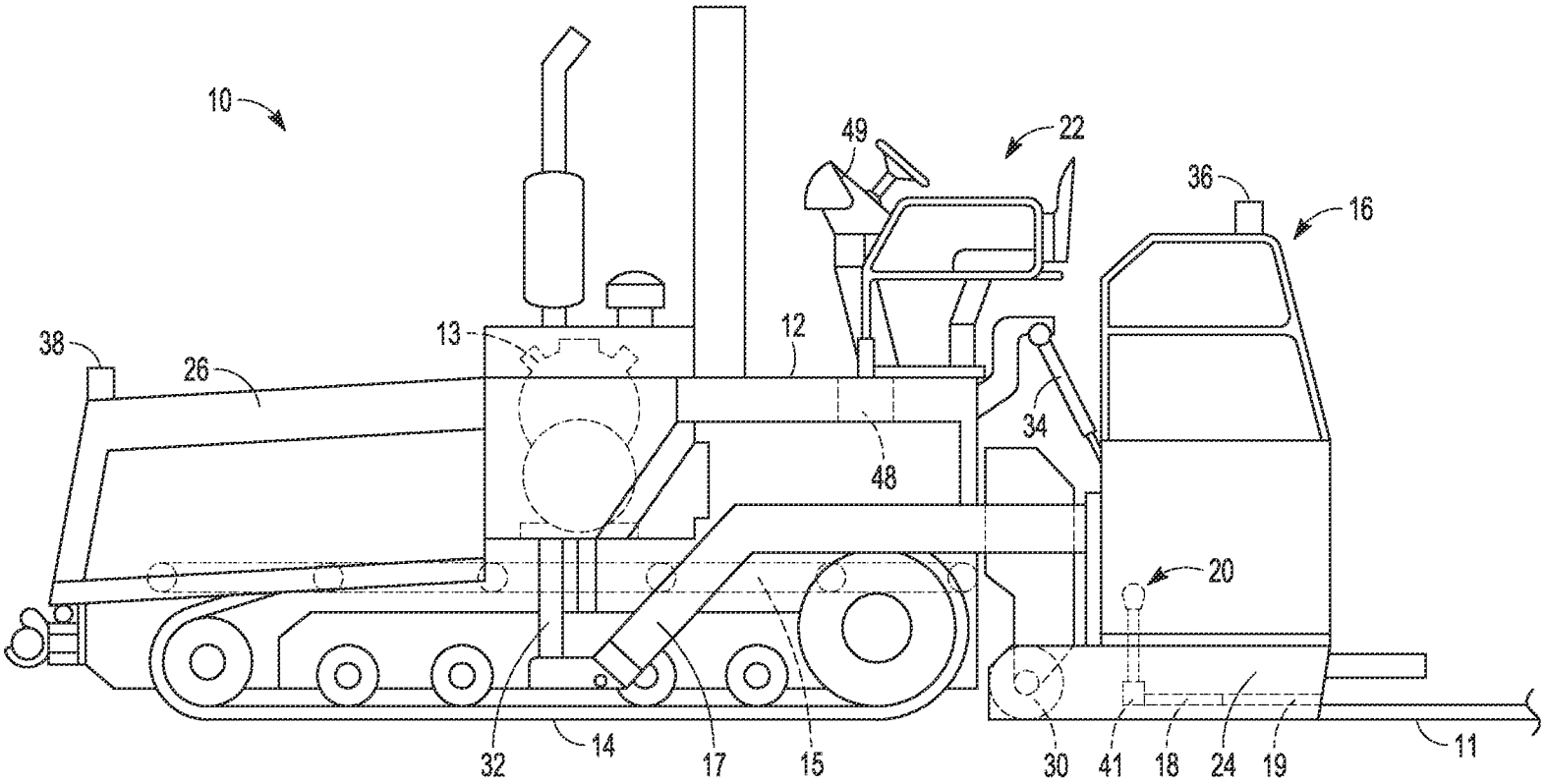
FIG. 1 shows a side view of a paving machine, in accordance with one embodiment.

FIG. 1 shows a side view of a paving machine 10 in accordance with one embodiment. The paving machine 10 generally includes a frame 12 with a set of ground-engaging elements 14 such as tracks or wheels coupled with the frame 12. The ground-engaging elements 14 may be driven by an engine 13 in a conventional manner. A screed 16 can be positioned at the rear end of the paving machine 10 to spread and compact paving material into an asphalt mat 11 having a desired thickness, size, uniformity, crown profile and cross slope. The paving machine 10 also includes an operator station 22 having a seat and a console, which includes various controls for directing operations of the paving machine 10 by inputting instructions at an input panel 49. A controller 48 is provided for electrically controlling various aspects of the paving machine 10. For example, the controller 48 can send and receive signals from various components of the paving machine during the operation of the paving machine 10.

The paving machine 10 further includes a hopper 26 for storing a paving material, and a conveyor system including one or more conveyors 15 configured to move paving material from the hopper 26 to the screed 16 at the rear of the paving machine 10. One or more augers 30 are arranged near the forward end of the screed 16 to receive the paving material supplied by the conveyor 15 and spread the material evenly beneath the screed 16.

Reference to the "forward" end of the screed 16 means the end of screed 16 facing in the direction of travel of paving machine 10 as paving machine 10 is applying the paving material to a surface (to the left in FIG. 1). Similarly, reference to a "forward-facing" surface of a component of screed 16 means a surface facing in the direction of travel of paving machine 10 while paving machine 10 is applying paving material to a surface, while reference to an "aft-facing" surface of a component means a surface facing away from the direction of travel of paving machine 10 while paving machine 10 is applying paving material to a surface (to the right in FIG. 1).

The screed 16 can be pivotally coupled behind the paving machine 10 by a pair of tow arms 17 that extend between the frame 12 of the paving machine and the screed 16. The screed 16 can be pivotally coupled behind the paving machine 10 by a pair of tow arms 17 that extend between a tow point on the frame 12 of the paving machine 10 and the screed 16. The tow arms 17 can be pivotally connected to the frame 12 such that the relative position and orientation of the screed 16 relative the surface being paved may be adjusted by pivoting the tow arms 17, for example, in order to control the thickness and grade of the paving material deposited by the paving machine 10.

The tow arms 17 can also have the tow point raised and lowered on the machine 10 using a positioning cylinder 32 which when moved up and down moves the tow point of the tow arms 17 and changes an angle of attach of the screed 16. Also, as part of the paving process, one or more cylinders 34 on the screed 16 can raise or lower portions of the screed 16. For example, to change a height or paving angle of a main screed plate 18 and one or more extender screed plates 19.

The screed 16 can include a screed frame 24 with the main screed plate 18 coupled to the screed frame 24. The screed plate 18 is configured to float on the paving material of the asphalt mat 11 laid upon a prepared paving bed and to "smooth" or level and compact the paving material on the base surface, such as for example a roadway or roadbed. The screed 16 can further include the one or more extender screed plates 19 that extend beyond the main screed plate 18 to extend the paving width of the screed 16.

The screed 16 can include a tamper bar assembly 20 positioned forward of the screed plate 18 and extending transversely to the direction of travel of the paving machine 10. The tamper bar assembly 20 may include a tamper bar 41. Tamper bar assembly 20 can be coupled to the screed frame 24 of screed 16 and configured such that the tamper bar 41 is reciprocated in an upward and downward direction substantially perpendicular to the asphalt mat 11 and substantially perpendicular to the direction of travel of paving machine 10. The tamper bar assembly 20 pre-compacts the paving material as the paving machine 10 moves forward and the screed 16 smooths the paving material to remove air pockets and other voids to create a flat, paved surface.

As noted above, a machine operator must control multiple variables of the paving machine and screed operation to maintain a smooth asphalt mat product behind the machine. However, the manual operation of the various paving characteristics can result in human error and lack of smoothness in the finished road surface. Therefore, a system is desired that can control the smoothness of the asphalt mat surface and can eliminate the human error.

Accordingly, the present system provides a plurality of sensors 36 positioned to scan a surface of the asphalt mat 11 behind the screed 16. The controller 48 can be coupled to the plurality of sensors 36. In one example, the controller 48 can be configured to determine a smoothness of the asphalt mat 11 based on the information from the sensors 36 and make changes to one or more paving characteristics of the paving machine 10 to improve the smoothness of the asphalt mat 11.

For example, such adjustments to the paving characteristics can include an adjustment to the speed of the paving machine 10, or the tamper rate of the tamper bar 41 can be adjusted, or the speed or height of the auger 30 can be adjusted, or the tow point height can be adjusted to change an angle of attack of the screed 16, or the controller 48 can change an extender screed plate height, change the machine speed, change the material feed speed, change the auger height or speed, or change the material head height.

In various embodiments, the plurality of sensors 36 can include lidar sensors, radar sensors, smart cameras, or other equipment capable of scanning the asphalt mat surface behind the screed 16 and transferring the information to the controller to enable the controller 48 to create a virtual 3D image of the surface.

Figure 2:
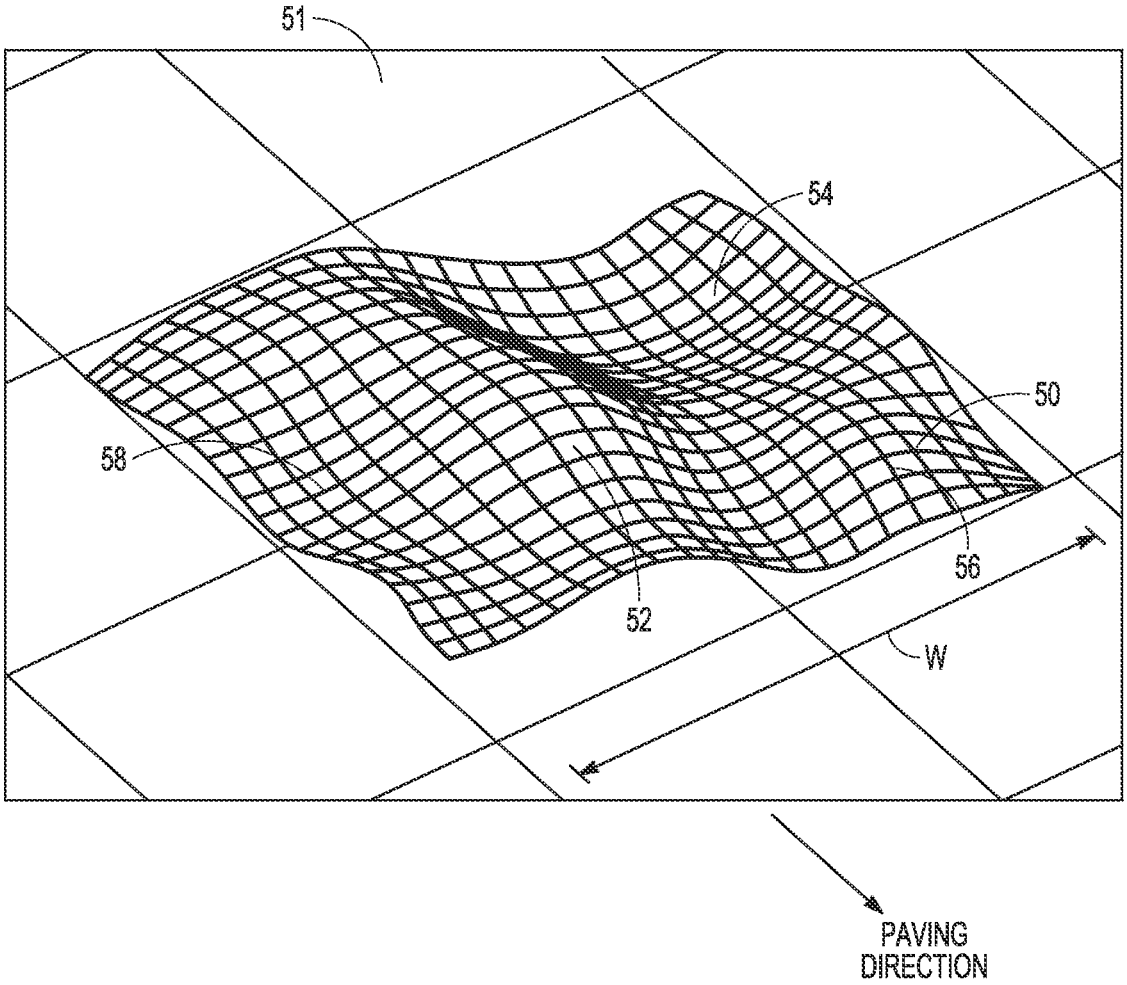
FIG. 2 shows a perspective view of a virtual 3D map of an asphalt mat, in accordance with one embodiment.

For example, FIG. 2 shows a perspective view of a virtual 3D map 50 of an asphalt mat, in accordance with one embodiment. As noted, the controller 48 can be configured to form a virtual 3D map 50 of the surface of the asphalt mat 11 based on input from the plurality of sensors 36. The virtual 3D map can indicate relative peaks 52, 56 and valleys 54, 58 in the asphalt mat surface relative to a virtual smooth plane 51.

In one example, the virtual 3D map 50 covers an entire width W of the screed 16. Is some examples, the 3D map can extend about 10 feet behind the screed. In other examples the 3D map extends a foot or less behind the screed. In some examples, the controller 48 can time-stamp the information in the virtual 3D map 50 for further analysis of the asphalt mat surface. Moreover, GPS information can also be included in the time-stamp. With all this information, the controller 48 can be configured to use machine learning to continually update the process and learn to improve the smoothness of the asphalt mat 11 depending on the factors and changes to paving characteristics.

Referring again to FIG. 1, the paving machine 10 can further include one or more sensors 38 positioned to scan an existing base surface in front of the paving machine 10 and the screed 16 to determine a relative smoothness and grade of the existing surface before asphalt is laid on the surface. The information from the sensors 38 can be sent to the controller 48. The controller 48 can be configured to change the one or more paving characteristics based on an analysis of the existing base surface. Such a system can be used for predictive analysis by controller 48, such that the controller 48 can make predictive changes to the paving characteristics discussed above, (tow point height, etc.), based on the scan of the existing base and the scan of the asphalt mat 11.

Again, machine learning can be used by the controller 48 so the controller 48 can improve at predicting how certain paving characteristic changes will affect the smoothness, and how the shape and grade of the existing base, before the asphalt is laid down, can affect the final smoothness. All these factors can be continually analyzed by the controller 48 to enable continual machine learning to determine optimal settings based on the existing base and the scanned smoothness of the asphalt mat.

Figure 3:
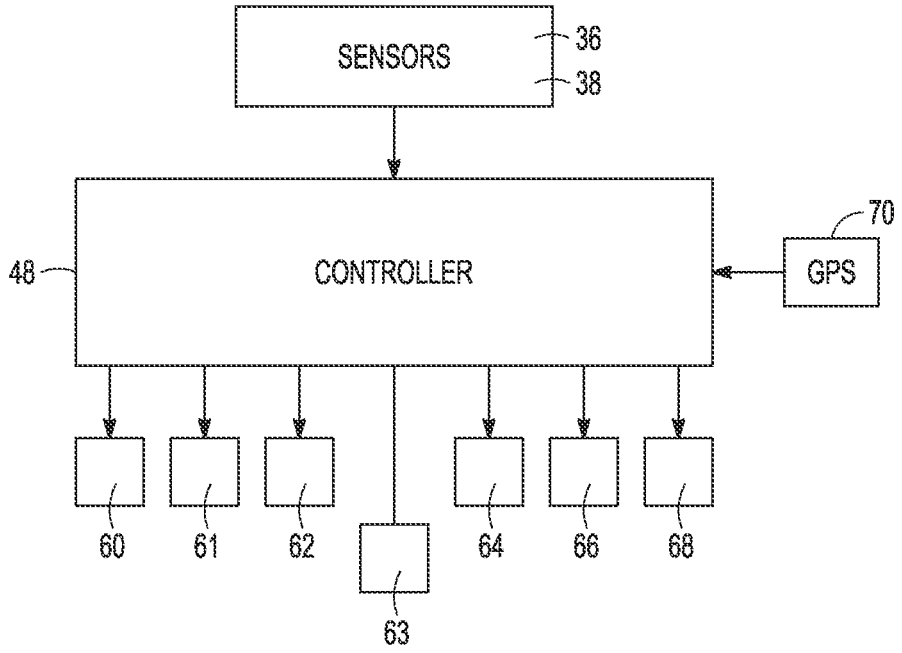
FIG. 3 shows a system of improving a smoothness of an asphalt mat, in accordance with one embodiment.

FIG. 3 shows a system for improving a smoothness of an asphalt mat, in accordance with one embodiment. The automatic smoothness system for a paving machine can generally includes the plurality of sensors 36, 38 positioned to scan a surface of an asphalt mat 11 behind a screed 16 of the paving machine 10, and to optionally scan an existing base in front of the screed 16. The controller 48 can be coupled to the plurality of sensors 36, 38. The controller 48 can be configured to determine a smoothness of the asphalt mat 11 and to make changes to one or more paving characteristics of the paving machine 10 to improve the smoothness of the asphalt mat 11. The controller 48 can be coupled to various components of the paving machine to control the action of the components. For example, based on the smoothness analysis, the controller 48 can change a tow point height 60 to change an angle of attack of the screed 16. The controller 48 can also be configured to change a screed extender height 61. This can be useful if a line appears between the primary screed plate 18 and the extender screed plate 19. Other paving characteristics of the system that can be changed by the controller can include one or more of a machine speed 62, a material feed speed 63, an auger speed or height 64, a paving material head height 66, and a tamper bar assembly movement 68.

Further, as noted above, GPS information can be provided to the controller from a GPS system 70 and furthermore, all the data can be time-stamped.

In one example, the smoothness data provided by the sensor 36 can be used in an automatic control of the paving machine 10 as above described without operator intervention.

INDUSTRIAL APPLICABILITY

The present system is applicable to paving systems. The smoothness of the asphalt mat 11 at various stages and times during the paving process can be improved. Accordingly, a process for improved smoothness has been devised.

Figure 4:
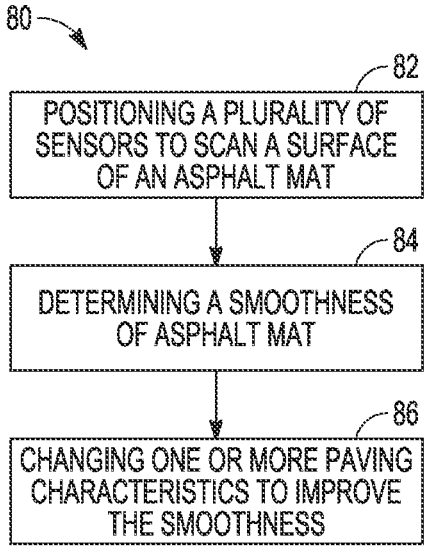
FIG. 4 shows a method for controlling a smoothness of an asphalt mat, in accordance with one embodiment.

FIG. 4 shows a method (80) of controlling a smoothness of an asphalt mat, in accordance with one embodiment. The method (80) can include positioning a plurality of sensors (82) to scan a surface of an asphalt mat behind a screed of the paving machine; determining a smoothness of the asphalt mat (84) using a controller coupled to the plurality of sensors; and changing one or more paving characteristics (86) of the paving machine to improve the smoothness of the asphalt mat.

In various embodiments, the one or more paving characteristics can include changing a tow point height to change an angle of attack of the screed, changing an extender screed plate height, changing the machine speed, changing the material feed speed, changing the auger height or speed, a changing the material head height, and changing the tamping characteristics.

As discussed, the controller 48 can be configured to form a virtual 3D map of the surface of the asphalt mat 11 based on input from the plurality of sensors, where the virtual 3D map covers an entire width of the screed.

The sensors can include lidar sensors, radar sensors or smart cameras, for example. The method can further include adding further sensors in front of the machine to scan the existing base surface to help the controller in predictive analysis.

In summary, the present system proposes an automatic smoothness control system for the asphalt paving machine 10. The system can include a plurality of sensors 36 to measure/scan the smoothness of the asphalt mat 11 directly behind the trailing edge of a screed 16. The measurement can be a 3D scan of the entire surface across the width of the screed plates 18, 19. The scanned data is sent to the controller 48 that analyzes this 3D topical data to detect smoothness, waviness, dips, or any other defect behind the screed 16. To improve the smoothness, the controller 48 of the paving machine 10 can utilize this data to send signals to the tow point cylinders 32 on the machine 10 to make corrections in the tow point height positions which can result in a better control over the screed 16. The present control system can be in addition to or layered upon the existing grade and slope controls which currently control asphalt mat grade, thickness, and side-to-side slope of a paving machine.

Moreover, other paving characteristics can be changed to provide improved smoothness of the asphalt mat 11. For example, the one or more paving characteristics include changing the screed extender plate 19 height, for example if a line appears in the asphalt mat between the primary screed plate 18 and the extender screed plate 19. Other paving characteristics that can be changed by the controller 48 can include one or more of a machine speed, a material feed speed, an auger speed and height, and a material head height, or the tamper bar operation.

The above detailed description is intended to be illustrative, and not restrictive. The scope of the disclosure should, therefore, be determined with references to the appended claims, along with the full scope of equivalents to which such claims are entitled.

What is claimed is:

1. A paving machine comprising:

a frame;

a screed coupled to the frame;

a plurality of sensors to scan a surface of a first laid asphalt mat section located behind the screed; and a controller coupled to the plurality of sensors, the controller configured to determine a smoothness of the first laid asphalt mat section located behind the screed and to make changes to one or more paving characteristics of the paving machine to improve the smoothness of a second laid asphalt mat section that is laid after and beyond the first laid asphalt mat section.

2. The paving machine of claim 1, wherein the plurality of sensors include lidar sensors.

3. The paving machine of claim 1, wherein the plurality of sensors include smart cameras.

4. The paving machine of claim 1, wherein the controller is configured to form a virtual 3D map of the surface of the first laid asphalt mat section based on input from the plurality of sensors.

5. The paving machine of claim 4, wherein the virtual 3D map covers an entire width of the screed.

6. The paving machine of claim 4, wherein the virtual 3D map includes time stamped information for further analysis of the asphalt mat surface.

7. The paving machine of claim 1, wherein the one or more paving characteristics include a tow point height to change an angle of attack of the screed.

8. The paving machine of claim 1, wherein the one or more paving characteristics include a screed extender plate height and the controller can change a height of one or more screed extender plates.

9. The paving machine of claim 1, wherein the one or more paving characteristics include one or more of a machine speed, a material feed speed, an auger speed and height.

10. The paving machine of claim 1, further including one or more sensors positioned to scan an existing base surface in front of the paving machine and wherein the controller is configured to change the one or more paving characteristics based on an analysis of the existing base surface.

11. An automatic smoothness system for a paving machine, the system comprising:

a plurality of sensors positioned to scan a surface of a first laid asphalt mat section located behind a screed of the paving machine; and a controller coupled to the plurality of sensors, the controller configured to determine a smoothness of the first laid asphalt mat section located behind the screed and to make changes to one or more paving characteristics of the paving machine to improve the smoothness of a second laid asphalt mat section that is laid after and beyond the first laid asphalt mat section, wherein the controller is configured to form a virtual 3D map of the surface of the asphalt mat based on input from the plurality of sensors, wherein the virtual 3D map covers an entire width of the screed.

12. The system of claim 11, wherein the plurality of sensors include lidar sensors.

13. The system of claim 11, wherein the plurality of sensors include smart cameras.

14. The system of claim 11, wherein the virtual 3D map includes time stamped information for further analysis of the first laid asphalt mat surface.

15. The system of claim 11, wherein the one or more paving characteristics include a tow point height to change an angle of attack of the screed.

16. The system of claim 11, wherein the one or more paving characteristics include a screed extender plate height and the controller can change a height of one or more screed extender plates.

17. The system of claim 11, further including one or more sensors positioned to scan an existing base surface in front of the paving machine, and wherein the controller is configured to change the one or more paving characteristics based on an analysis of the existing base surface for predictive analysis by the controller.

18. A method of controlling a smoothness of an asphalt mat behind a paving machine, the method comprising:

positioning a plurality of sensors to scan a surface of a first laid asphalt mat section located behind a screed of the paving machine;

determining a smoothness of the first laid asphalt mat section located behind the screed using a controller coupled to the plurality of sensors; and changing one or more paving characteristics of the paving machine to improve the smoothness of a second laid asphalt mat section that is laid after and beyond the first laid asphalt mat section.

19. The method of claim 18, wherein the one or more paving characteristics include a tow point height to change an angle of attack of the screed.

20. The method of claim 18, wherein the one or more paving characteristics include a screed extender height and the controller can change a height of one or more screed extenders.

* * * * *